US007300371B2

(12) United States Patent
Volin et al.

(10) Patent No.: US 7,300,371 B2
(45) Date of Patent: Nov. 27, 2007

(54) APPARATUS FOR DEFLECTING OR INVERTING MOVING WEBS

(75) Inventors: Leonard M. Volin, Stillwater, MN (US); Mark J. Zach, Northfield, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 597 days.

(21) Appl. No.: 10/854,898

(22) Filed: May 27, 2004

(65) Prior Publication Data

US 2005/0277504 A1 Dec. 15, 2005

(51) Int. Cl.
*F16H 7/00* (2006.01)
*B65H 20/00* (2006.01)

(52) U.S. Cl. ..... 474/84; 226/170; 226/192

(58) Field of Classification Search ..... 474/84–87, 474/62; 264/40.7, 177.17; 226/19–21, 16, 226/97, 170, 190, 197, 192; 26/51.5, 100; 242/56.32, 615.21
See application file for complete search history.

(56) References Cited

U.S. PATENT DOCUMENTS

| | | | | |
|---|---|---|---|---|
| 3,052,395 | A | 9/1962 | Scott | |
| 3,095,131 | A | 6/1963 | Robertson et al. | |
| 3,434,639 | A | 3/1969 | Cowles | |
| 3,637,122 | A | 1/1972 | Tokunaga | |
| 3,684,148 | A | 8/1972 | Upmeier | |
| 3,743,152 | A | 7/1973 | Greeves | |
| 4,155,496 | A | 5/1979 | Houck | |
| 4,343,422 | A | 8/1982 | Dabringhaus et al. | |
| 4,545,516 | A | 10/1985 | Miyai | |
| 4,687,125 | A | 8/1987 | Hashimoto et al. | |
| 4,760,627 | A * | 8/1988 | Schele | 226/18 |
| 5,246,099 | A | 9/1993 | Genovese | |
| 6,013,212 | A | 1/2000 | Planeta et al. | |
| 6,550,656 | B2 | 4/2003 | Kurz | |
| 6,595,465 | B2 | 7/2003 | Lamothe | |

FOREIGN PATENT DOCUMENTS

| | | |
|---|---|---|
| DE | 3827864 | 2/1990 |
| DE | 38 29 787 A1 | 3/1990 |

(Continued)

OTHER PUBLICATIONS

Co-pending U.S. Appl. No. 10/676,188, filed Sep. 30, 2003.

*Primary Examiner*—Marcus Charles
(74) *Attorney, Agent, or Firm*—Brian E. Szymanski; Douglas B. Little

(57) ABSTRACT

A diverting roller has a roller body having a longitudinal axis. A plurality of pairs of pulleys are rotatably mounted on the roller body adjacent a circumference of the roller body. An endless belt is looped around each of the pairs of pulleys in such a fashion that each belt has substantial portion oriented in a direction parallel to the longitudinal axis of the roller body. The travel of belts around their respective pulleys permits a non-normal angle of incidence of the web to the longitudinal axis. The non-normal angle of incidence and the travel of the belts permit the axial movement of a web of indefinite length material when the web is in contact with belts of the diverting roller. One or more of the diverting rollers may be employed in a system for inverting a moving web of indefinite length material.

4 Claims, 2 Drawing Sheets

FOREIGN PATENT DOCUMENTS

| | | | | |
|---|---|---|---|---|
| DE | 4100078 | | | 7/1991 |
| DE | 42 13 208 | C2 | | 10/1993 |
| DE | 4322114 | | | 1/1994 |
| DE | 19751417 | C1 | * | 6/1999 |
| DE | 10223643 | A1 | * | 1/2003 |
| EP | 0 437 231 | A2 | | 7/1991 |
| EP | 0878300 | A1 | * | 11/1998 |
| EP | 1270474 | A2 | * | 1/2003 |
| JP | 59 092857 | | | 5/1984 |
| JP | 01034846 | | | 2/1989 |
| JP | 10087136 | | | 4/1998 |
| JP | 2001294351 | | | 10/2001 |
| WO | WO 05/032990 | A1 | | 4/2005 |

* cited by examiner

APPARATUS FOR DEFLECTING OR INVERTING MOVING WEBS

TECHNICAL FIELD

The present invention relates to controlling the motion of moving webs of indefinite length, and more particularly to a device for changing the direction or inverting such webs.

BACKGROUND

Numerous commercial products incorporate material that has undergone processing in the form of a web of indefinite length material during some stage of its manufacture. When such webs are being processed, it is frequently desirable to divert the web to a different direction, or to invert the web so the opposite side of the web is facing upwards to receive, e.g., the application of a coating. For many applications it is conventional to wrap the web partially around one or more non-rotating air flotation devices called "air bars" or "air turns" in order to divert or invert the web. However, in some circumstances the use of an air bar is inconvenient. For example the web may be too heavy, too porous, or too textured for the needed air cushion to develop. In such circumstances, it is known that apparatuses that have, e.g., guide rotors disposed in spiral curves may be employed. However, these alternatives are bulky and complicated to construct.

Co-pending and coassigned U.S. patent application Ser. No. 10/676,188, "Apparatus For Deflecting or Inverting Moving Webs," discloses a slat roller with a roller body having a longitudinal axis. A plurality of slats are mounted on a circumference of the roller body in such a fashion that the slats may translate from a first position in a direction parallel to the longitudinal axis of the roller body. While this is effective for diverting or inverting webs that cannot use an air turn, the slats on this slat roller must reverse direction twice per revolution to travel from a starting position to a translated position, then return. This requirement places a practical limit on the ultimate web speed that the roll can deal with. Further, this slat roller operates best when the wrap angle of the web with respect to the roller is 180 degrees or less.

SUMMARY OF THE INVENTION

The present invention provides a diverting roller for controlling the movement of moving web of indefinite length material. Such a diverting roller has a roller body having a longitudinal axis. A plurality of pairs of pulleys are rotatably mounted on the roller body adjacent a circumference of the roller body. An endless belt is looped around each of the pairs of pulleys in such a fashion that each belt has substantial portion oriented in a direction parallel to the longitudinal axis of the roller body. The travel of belts around their respective pulleys permits a non-normal angle of incidence of the web to the longitudinal axis. A non-normal angle of incidence to the longitudinal axis indicates that the centerline of the web is not at about 90 degrees with the longitudinal axis of the roller as the web makes contact with the endless belts of the diverting roller.

In another aspect the present invention provides a system for inverting a moving web of indefinite length material, the heart of which is a pair of diverting rollers. Each diverting roller has a roller body having a longitudinal axis. A plurality of pairs of pulleys are rotatably mounted adjacent the circumference of the roller body. An endless belt is looped around each of the pairs of pulleys in such a fashion that each belt has substantial portion oriented in a direction parallel to the longitudinal axis of the roller body. In a preferred embodiment, the system also has a first and a second roller for conveying the moving web between the first and the second diverting rollers, such that when the moving web, starting in a first orientation, is directed around the first diverting roller, the first and second idler rollers and the second diverting roller, it emerges in a second orientation which is inverted from the first orientation.

In a most preferred embodiment of the system the two diverting rollers are rotatably mounted with their longitudinal axes generally perpendicular to each other. Also, in most convenient embodiments, the roller body is rotated and the endless belts are caused to travel around their respective pulleys in a passive manner in contact with the moving web. The travel of the belts permits a non-normal angle of incidence of the web to the longitudinal axis of the diverting roller.

BRIEF DESCRIPTION OF THE DRAWINGS

In the several figures of the attached drawing, like parts bear like reference numerals, and.

DETAILED DESCRIPTION

Figure 1:
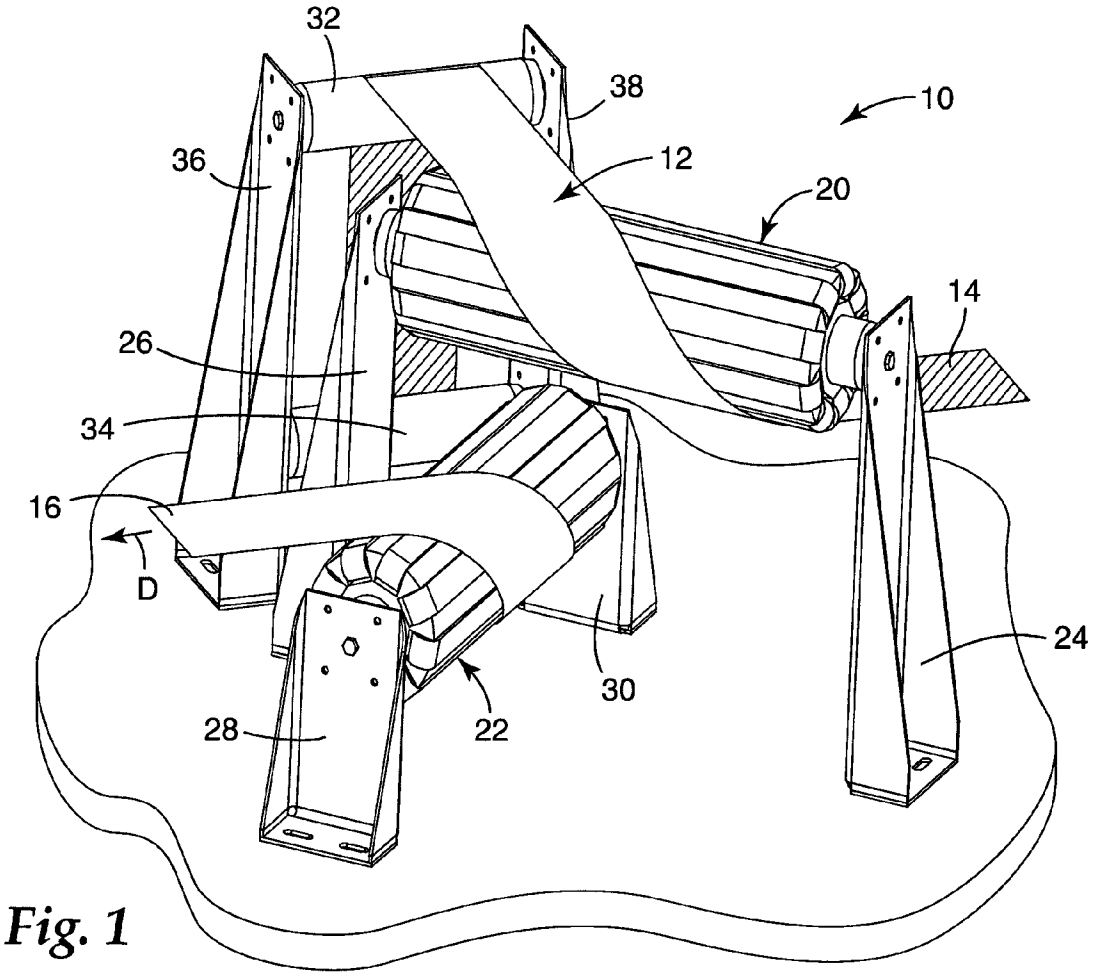
FIG. 1 illustrates a perspective view of an exemplary web handling system incorporating the apparatus according to the present invention.

Referring now to FIG. 1, a perspective view of an exemplary web handling system 10 according to the present invention is illustrated. The system 10 is shown guiding a segment of a web 12 of indefinite length material, the web 12 having a first side 14 and a second side 16 and moving in direction "D". The system 10 includes a first diverting roller 20 and a second diverting roller 22, with the first diverting roller 20 conveniently rotatably mounted on supports 24 and 26 and the second diverting roller 22 conveniently mounted on supports 28 and 30. The system 10 also includes a first idler roller 32 and a second idler roller 34 for conveying the moving web between the first and the second diverting rollers 20 and 22. The first idler roller 32 and the second idler roller 34 are conveniently rotatably mounted on supports 36 and 38. It will be noted that first and the second diverting rollers 20 and 22 are mounted with their longitudinal axes generally perpendicular to each other in this Figure, and this is often convenient in many preferred embodiments of the invention. It will also be observed in the depicted embodiment the web 12 has been inverted: after passing through system 10, first side 14 which had been face up is now placed face down.

The non-normal angle of incidence of the web to the longitudinal axis of the diverting roller is suitable for either inverting a web or changing the orientation, or direction, of the web. The non-normal angle of incidence and the travel of the belts around their respective pulleys permit the axial movement of the web when the web is in contact with belts of the diverting roller. In general, the contact surface between the web and the belts is a greater distance from the roller axis than the outer surfaces of the roller body such that the web will contact the belts and not the roller body.

Figure 2:
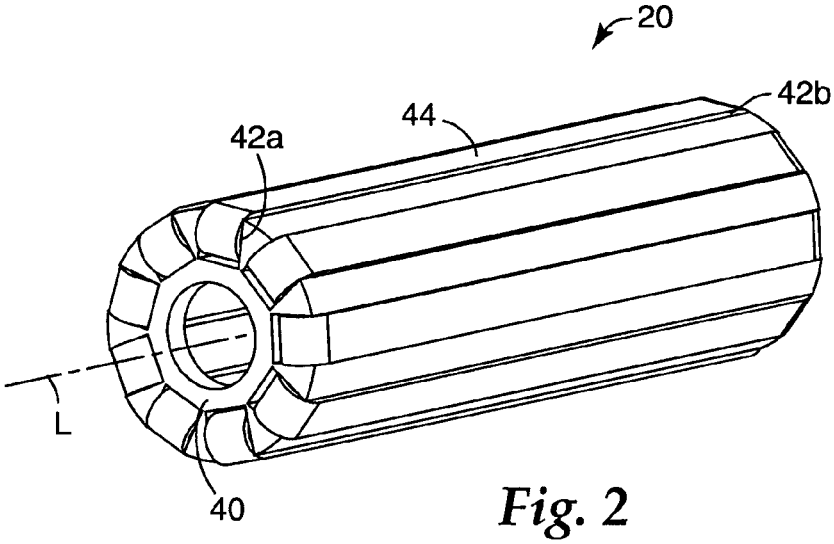
FIG. 2 illustrates a detail view of a diverting roller in isolation.

Referring now to FIG. 2, a detail view of diverting roller 20 is illustrated in isolation. The diverting roller 20 has a roller body 40 having a longitudinal axis "L," and having a plurality of pairs of pulleys 42, pulley 42*a* and pulley 42*b* being one such pair. The pulleys 42 are rotatably mounted on the roller body 40 adjacent a circumference of the roller body 40. A plurality of endless belts 44 are each mounted on one of the pairs of pulleys 42 in such a fashion that the belts 44 have a substantial portion of their length oriented parallel to longitudinal axis "L". The belts 44 are free to travel around their respective pulley pair 42 in the usual manner of belts and pulleys.

Figure 3:
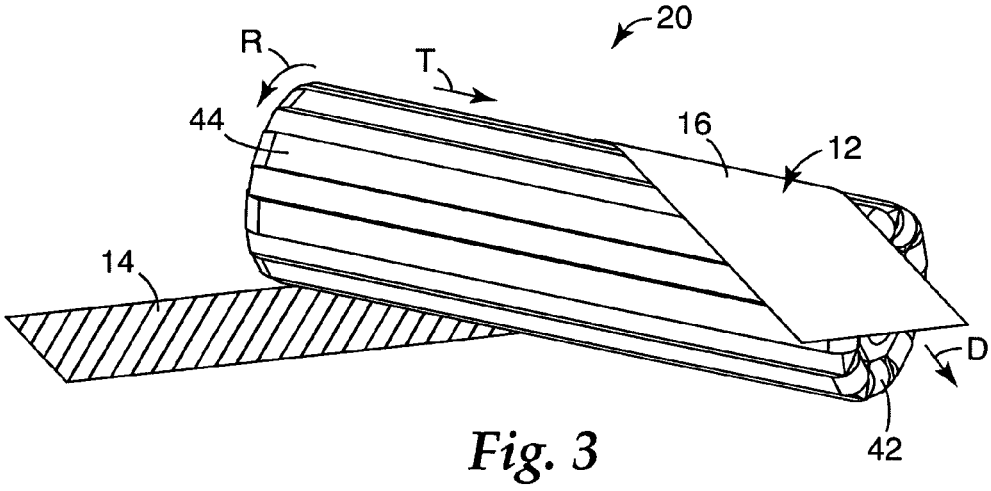
FIG. 3 illustrates a reverse angle view of the diverting roller of FIG. 2, with a section of web in position.

Referring now to FIG. 3, a reverse angle view of the diverting roller 20 of FIG. 2 is illustrated with a section of web 12 in position. In this view it can be appreciated that when the diverting roller 20 is rotated passively in contact with moving web 12 in rotation direction "R", then the belts 44 are themselves driven to travel in direction "T" by contact with the web 12. Thus the relative motion of the belt 44 to the web 12 is essentially zero, and the web 12 is protected from being damaged by friction in spite of the non-normal angle of incidence of the web 12 to the diverting roller 20.

The depicted embodiment of diverting roller 20 includes nine pulley pairs 42 each supporting one endless belt 44. At least two belts 44 must be provided, but it is frequently desirable to provide more, particularly when the system 10 is operating with the diverting rollers 20 and 22 being passively driven by contact with the moving web 12. It will be appreciated that although providing more belts 44 and pulley pairs 42 will increase the cost and complexity of a diverting roller 20, the greater number of belts reduces the force applied by the web to an individual belt. The diameter of the roller body 40 and its length will also be seen to be variables affecting the amount of force the web 12 imparts to the belts 44 to cause them to travel around their respective pair of pulleys 42. It is contemplated that properly constructed diverting rollers 20 according to the present invention may be operated in connections with very high web speeds, up to or above 1000 fpm.

The preferred embodiment of the present invention has been described utilizing the moving web as the primary driving force for imparting motion to the endless belts and for imparting rotation of the roller or rollers. Those skilled in the art recognize that driven rollers and/or belts may be desirable for certain webs or web processing environments. Various modifications and alterations of the present invention will be apparent to those skilled in the art without departing from the scope and spirit of this invention, and it should be understood that this invention is not limited to the illustrative embodiments set forth herein.

The invention claimed is:

1. A diverting roller for controlling the movement of moving web of indefinite length material, comprising:

a rotatable roller body having a longitudinal axis and at least two channels formed in the surface of the roller body oriented axially and extending the length of the roller body;

at least two pairs of pulleys, each pulley rotatably mounted adjacent a circumference on the roller body and at an end of one of said channels; and at least two endless belts, which are not driven other than by contact with the moving web, each belt mounted on one of the pairs of pulleys in such a fashion that each belt has substantial portion oriented in a direction parallel to the longitudinal axis of the roller body, said belts lying in said channels.

2. A system for inverting a moving web of indefinite length material, comprising: employing at least one diverting roller of claim 1.

3. A system for inverting a moving web of indefinite length material comprising:

a first diverting roller and a second diverting roller each comprising a rotatable roller body having a longitudinal axis and at least two channels formed in the surface the roller body oriented axially and extending the length of the roller body, at least two pairs of pulleys located at the ends of such channels, and a belt mounted between each pair of pulleys and lying in the channel;

one or more rollers for conveying the moving web between the first diverting roller and the second diverting roller, such that when the moving web, starting in a first orientation, is directed around the first diverting roller at a non-normal angle of incidence to the first diverting roller longitudinal axis, the one or more rollers and the second diverting roller, it emerges, at a non-normal angle of incidence to the second diverting roller longitudinal axis, in a second orientation which is inverted from the first orientation, the sides of the web facing directions opposite from those they faced upon entering the system.

4. The system for inverting a moving web of indefinite length internal according to claim 3 wherein the first and the second diverting rollers are rotatably mourned with their longitudinal axes generally perpendicular to each other.

* * * * *

UNITED STATES PATENT AND TRADEMARK OFFICE

CERTIFICATE OF CORRECTION

PATENT NO. : 7,300,371 B2
APPLICATION NO. : 10/854898
DATED : November 27, 2007
INVENTOR(S) : Leonard M. Volin It is certified that error appears in the above-identified patent and that said Letters Patent is hereby corrected as shown below:

Col. 4
Line 26, in Claim 3, after "surface" insert -- of --.
Line 46, in Claim 4, delete "internal" and insert -- material --, therefor.
Line 47, in Claim 4, delete "mourned" and insert -- mounted --, therefor.

Signed and Sealed this

First Day of April, 2008

JON W. DUDAS
*Director of the United States Patent and Trademark Office*